US008215857B2

(12) United States Patent
Carroll

(10) Patent No.: US 8,215,857 B2
(45) Date of Patent: Jul. 10, 2012

(54) RETRACTABLE SUBSTANCE DISPENSER

(76) Inventor: Craig Carroll, Newport Beach, CA (US)

( * ) Notice: Subject to any disclaimer, the term of this patent is extended or adjusted under 35 U.S.C. 154(b) by 1266 days.

(21) Appl. No.: 11/873,288

(22) Filed: Oct. 16, 2007

(65) Prior Publication Data

US 2009/0097899 A1 Apr. 16, 2009

(51) Int. Cl.
*B43K 24/02* (2006.01)

(52) U.S. Cl. ..... 401/107; 401/108

(58) Field of Classification Search ..... 401/107–109, 401/202, 213, 243–248
See application file for complete search history.

(56) References Cited

U.S. PATENT DOCUMENTS 3,359,992 A 12/1967 Cishek et al.
4,533,272 A * 8/1985 Sakai ..... 401/107
5,048,990 A 9/1991 Hashimoto et al.
5,171,096 A 12/1992 Perrotti
6,283,658 B1 9/2001 Estevez et al.
6,371,129 B1 * 4/2002 Le Bras-Brown et al. .... 132/218
6,554,516 B1 4/2003 Christopher
7,128,488 B2 * 10/2006 Kageyama et al. ..... 401/107
7,331,730 B2 2/2008 Fukui et al.
2004/0184865 A1 9/2004 Carroll
2006/0002756 A1 1/2006 Kageyama et al.
2007/0166095 A1 7/2007 Samuelson et al.

FOREIGN PATENT DOCUMENTS

WO PCT/US2008/074957 11/2008
WO PCT/US2008/074958 11/2008

* cited by examiner

*Primary Examiner* — Davis Hwu
(74) *Attorney, Agent, or Firm* — John K. Buche; Buche & Associates, P.C.

(57) ABSTRACT

The application relates to a dispenser featuring a body and a reservoir housed in said body wherein the reservoir is configured to hold a substance; wherein there is an applicator selectively extendable or retractable from the dispenser; and further featuring a means for ejecting the substance through the applicator.

34 Claims, 8 Drawing Sheets

RETRACTABLE SUBSTANCE DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application is in the field of apparatus for dispensing cosmetic substances.

2. Background of the Invention

The ideal cosmetic dispenser is non-messy, portable, capable of storage, rapid delivery and easy application of a cosmetic substance. Typical cosmetic dispensers have a substance compartment whose contents may be emitted or placed onto an applicator for cosmetic application.

Ordinarily, cosmetics dispensers come equipped with a detachable lid or cap that is pulled or twisted off from the dispenser to expose the applicator. The purpose of the lid is to protect the applicator from outside corruption and prevent unintentional transfer of substance away from the applicator. One problem with this type of dispenser is that a contained substance can be wasted through inadvertent expulsion into the lid. Another problem with this type of dispenser arises through unmindful removal or replacement of the lid over the applicator since the substance invariably smears to the outside or the attaching portion of the lid. When this happens, subsequent lid removal becomes increasingly difficult and the cosmetic substance unwittingly dirties the dispenser user's hands. It is also difficult, with the traditional dispenser to maintain a sanitary applicator. Another drawback for this type of dispenser is that it requires two hands to remove the lid. Yet another problem is that the removable cap can easily be lost.

Cosmetic dispensers typically have some method to accomplish substance expulsion. Ordinarily, expulsion is triggered by manually twisting a driver, or by squeezing the compartment. However, twisting is undesirable because it takes two hands and is time consuming. Squeezing is undesirable because the amount of substance emitted is not easily metered, and can lead to substance waste because squeezing does not easily remove all the substance from the containing compartment.

SUMMARY OF THE INVENTION

Accordingly, it an objective of the present application to provide a cosmetic dispensing apparatus featuring a retractable applicator that permits elective exposure or concealment of the applicator.

It is a further object of the present application to provide a dispensing apparatus which allows elective expulsion of a substance while the applicator is exposed.

It is yet a further object of the present application to provide a dispensing apparatus without a detachable lid or cap, but which apparatus still protects the applicator from outside corruption.

It is yet a further object of the present application to provide a dispensing apparatus which may be used sufficiently with one hand.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which:

FIG. 3 is meant to illustrate and inventory some of the individual components of a dispenser 1 of FIG. 1. FIG. 3 also represents a plan for fitting various components together to construct a dispenser 1 of FIG. 1.

FIG. 6 is meant to illustrate and inventory some of the individual components of a dispenser 101 of FIGS. 4 and 5. FIG. 6 also represents a plan for fitting various components together to construct a dispenser 101 of FIGS. 4 and 5.

Figure 1A:
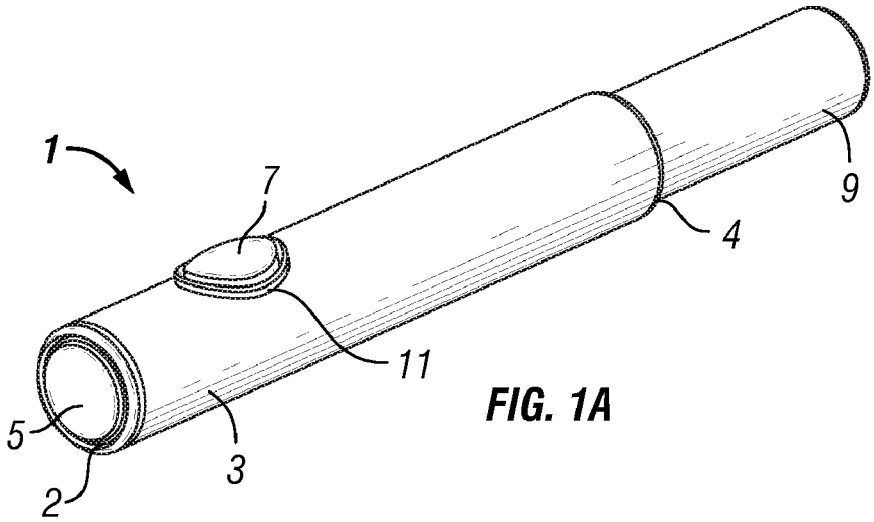
FIG. 1A is a perspective view of a dispenser 1 in a closed configuration.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

The dispenser 1 of the present application usually has an enclosure capable of containing substances and a suitably placed applicator 17 which acts as avenue from an enclosure to an applicator tip 18. Additionally, there is typically a means for inducing movement of the stored substance along the applicator shaft 15, culminating with expulsion of contained substance through an applicator tip 18. The applicator 17 (usually featuring an applicator tip 18 and an applicator shaft 15) of this dispenser 1 is suitably retractable, or extendable, and operationally configured to be concealed internally until electively exposed for use, and then electively re-concealed.

FIG. 1A depicts a dispenser 1 in a closed configuration. The figure shows a dispenser body 3 featuring an orifice 11 through which a button 7 typically protrudes or is otherwise accessible. FIG. 1A also shows the anterior of the dispenser body 3 suitably occupied by a cap 5 which may variably shut the anterior opening 2 of the body 3. The posterior of the body 3 is suitably occupied by a plunger 9 that typically coaxially merges into (or with) the body 3 by way of the posterior opening 4. In FIG. 1A, the plunger 9 represents a deactivated trigger; the anterior opening 2 represents an exit location for the applicator 17. As discussed in further detail below, the button 7 is an inactive reversion means, meaning that it may be used to release the applicator 17 from a fixed extended position so that it may be selectively retracted by the user into the body of the dispenser 1. Also discussed further below, in FIG. 1A the body 3 and plunger 9 have various internally concealed components.

Figure 1B:
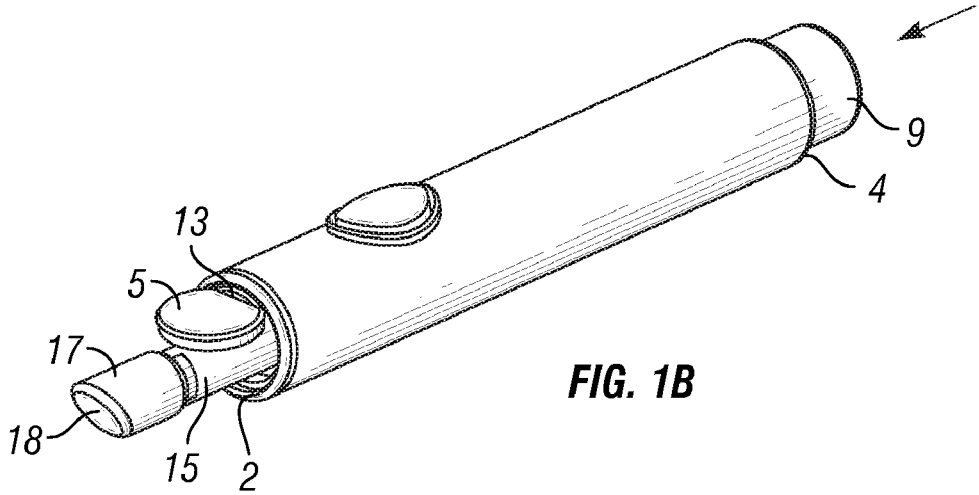
FIG. 1B is a perspective view of a dispenser 1 in an open configuration, with applicator 17 exposed, and with a plunger 9 partially depressed.

FIG. 1B typifies a dispenser in an open configuration. The figure illustrates a cap 5 opened along hinge 13, as well as the protrusion of a applicator 17 through the exposed anterior opening 2. An activated button 7 is accessible through the orifice 11, and a partially depressed plunger 9 extends from the posterior opening 4. In FIG. 1B, the plunger 9 is partially depressed and the anterior opening 2 is the exit location for applicator 17. As discussed further below, the button 7 is suitably an activated reversion means. Also discussed further below, in FIG. 2B the body 3 and plunger 9 have various internal components.

The dispenser 1 of the present application has a suitably retractable applicator 17 which may be electively exposed for applicator tip 18 use. Elective transition from a closed to an open configuration is usually achieved through application of an initiating force which suitably activates the plunger 9 as a trigger, exposes anterior opening 2, and protrudes the applicator 17 from the dispenser 1. In most cases, the acting force on the plunger 9 will be generated by the user manually, for instance by a thumb or finger. The dispenser 1 typically has a natural tendency to revert from an open to a closed configuration. As discussed further herein, during transition from closed to open configurations, this tendency is normally continuously opposed to applicator 17 protrusion and plunger 9 activation. However, once the plunger 9 has been activated, the applicator 17 is suitably locked in external position and natural reversion to a closed configuration is prevented. Also discussed further herein, once the dispenser 1 is suitably locked into an open configuration, the button 7 suitably becomes an activated reversion means which may electively be acted upon to release the lock, thereby enabling the aforementioned natural tendency to actuate reversion to a closed configuration. FIGS. 1A and 1B together may help visualize this transition. Referring to these two figures, when an external axial force is applied to the butt of the plunger 9 in FIG. 1A, such force depresses the plunger 9, opens the cap 5 along hinge 13, and projects applicator 17 from the anterior opening 2. Once the force moves the plunger 9 to its partially depressed position in FIG. 1B, plunger 9 and button 7 are activated and the configuration is usually locked in place. At this point reversion to the closed state of FIG. 1A normally can only be attained through interaction with button 7. See the discussion below for more details.

Figure 1C:
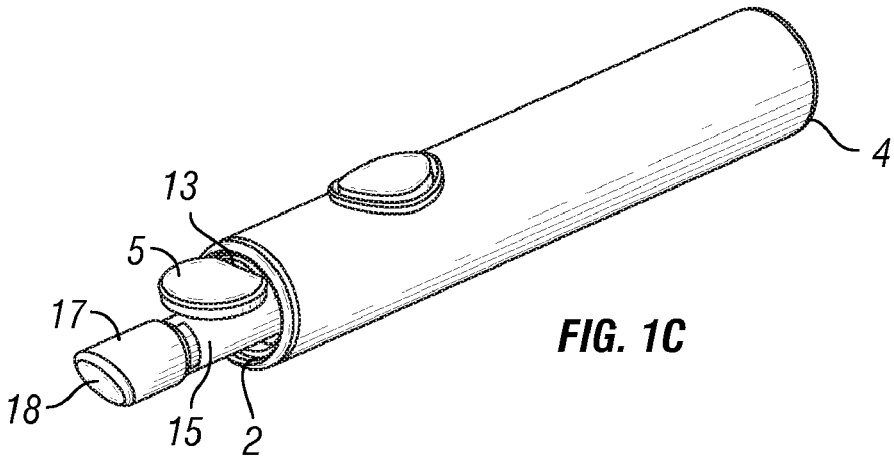
FIG. 1C is a perspective view of a dispenser 1 in an open and dispensing configuration, with applicator 17 exposed, and with a plunger 9 fully depressed.

During expulsion of contained substance through an exposed applicator tip 18, the dispenser 1 is in an open and dispensing configuration. FIG. 1C depicts a dispenser 1 in such an open and dispensing configuration. The figure shows most labeled components in roughly the same relative positions as that of FIG. 1B, but the plunger 9 is suitably depressed fully toward the body 3. The depressed and active plunger 9 of FIG. 1C is an active trigger, at which point cosmetic substance is typically forcibly ejected from a applicator tip 18 of the dispenser 1.

Transition from an open to an open and dispensing configuration, followed by suitable reversion, is usually achieved by way of an motive force placed upon the contained substance, that is caused by the plunger 9 being fully depressed and active. A fully depressed and active plunger 9 typically results from axial impulse on the end of the activated plunger 9, as shown in FIG. 1B. As discussed in more detail below, said impulse induces metered dispensing of a contained substance from the exposed applicator tip 18. Applicator 17 may feature at least one, or a plurality of orifices through which substance may be expelled. Dissipation of the aforementioned impulse results in reversion of the plunger 9 from fully to partially depressed and suitably ends dispensing of substance until a new impulse is triggered. Usually there is no mechanism to lock the dispenser in an open and dispensing configuration. FIGS. 1B and 1C together may help visualize this process. Referring to these two figures, when an external axial impulse is applied to the butt of the plunger 9 in FIG. 1B, said impulse usually fully depresses the plunger 9 to its position in FIG. 1C which induces metered expulsion of a contained substance from applicator tip 18. Upon dissipation of said axial impulse, suitably the plunger 9 of FIG. 1C automatically returns to its position in FIG. 1B. A typical use cycle would entail impulsive depression of the plunger 9 from its position in FIG. 1B to that of FIG. 1C, followed by reversion to its position in FIG. 1B. Normally, the cosmetic dispensing feature of dispenser 1 is accomplished by the plunger 9 being cycled repeatedly to cause sufficient accumulation of contained substance at the applicator tip 18, where a user would then apply the substance to the lips, eyes, face, or the like.

The specifics of the applicator 17 (usually including the applicator shaft 15 and applicator tip 18) depend on the type of substance and the nature of the dispenser 1 purpose. In the accompanying figures, the applicator tip 18 is a hollow truncated cylinder with an angled cylindrical section as the applicator tip 18 surface, as one might see in a lip gloss applicator. In some instances, however, the applicator tip 18 may just be an orifice or other type of opening through which a substance may be discharged. In another instance, the applicator tip 18 may be a membrane through which substance may be expelled. In yet another instances, the applicator tip 18 may be some type of rigid member to which expelled substances may adhere while awaiting application (e.g., a brush for mascara).

Figure 2A:
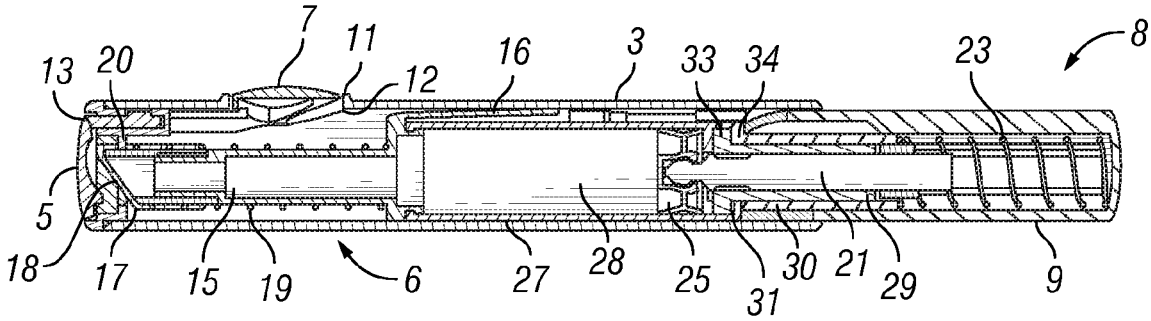
FIG. 2A is a longitudinal cross-section of the dispenser 1 of FIG. 1A.

FIG. 2A is a longitudinal cross-section of the dispenser 1 of FIG. 1A. The figure shows a dispenser 1 with a closed cap 5 and body hollow 6 which houses the applicator 17 including the applicator shaft 15 and applicator tip 18, the retraction spring 19, the contracted arm 16, ledge 12, a movable reservoir body 27 (which contains the piston 25, and part of the plunger shaft 21), drive gear 29, and crank 30. The figure also shows a dispenser with a plunger cavity 8 that houses the plunger spring 23 and most of the plunger shaft 21, drive gear 29 and crank 30. In FIG. 2A the plunger 9 is fully extended away from the body 3 and the internal components of the body hollow 6 are toward the body 3 posterior. The reservoir body 27 and its chamber 28 are an enclosure configured to contain cosmetic substances, which are usually fluid or powder in nature. Typical substances might include, but are not limited to, lipstick, mascara, lip gloss, blemish remover, concealers, eyeliners, and the like as will be appreciated by those skilled in the industry. The applicator shaft 15 suitably defines an avenue or channel between the applicator tip 18 and the chamber 28 containing substance. In other words, the applicator shaft 15 and chamber 28 are suitably in fluid connection with one another.

Figure 2B:
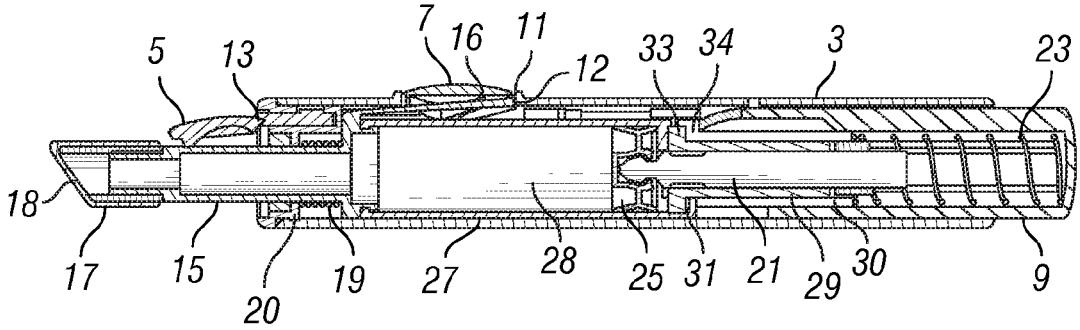
FIG. 2B is a longitudinal cross-section of the dispenser 1 of FIG. 1B.

FIG. 2B is a longitudinal cross-section of the dispenser 1 of FIG. 1B. The figure depicts a dispenser 1 with a cap 5 opened along hinge 13, applicator 17 (which usually includes applicator tip 18 and applicator shaft 15) protruding through exposed anterior opening 2. The body hollow 6 houses the retraction spring 19 which is compressed against the spring stop 20; the arm 16 extended to the ledge 12; and the reservoir body 27, which is locked in its position and which contains the piston 25 and part of the plunger shaft 21, drive gear 29, and crank 30. The figure also shows a dispenser 1 with a plunger cavity 8 that houses the plunger spring 23, idle plunger shaft 21, drive gear 29, and crank 30. In FIG. 2B the activated plunger 9 is more depressed toward the body 3 than the deactivated plunger 9 of FIG. 2A and the internal components of the body 3 hollow 6 are more toward the body 3 anterior.

Figure 2C:
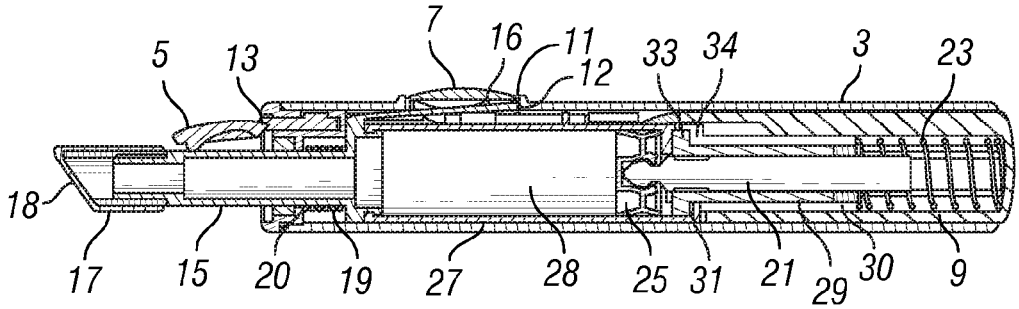
FIG. 2C is a longitudinal cross-section of the dispenser 1 of FIG. 1C.

FIG. 2C is a longitudinal cross-section of the dispenser 1 of FIG. 1C. FIG. 2C is the same as FIG. 2B except the figure shows a dispenser 1 with an fully depressed plunger 9 and plunger cavity 8 which houses the compressed plunger spring 23, the working plunger shaft 21, piston 25, drive gear 29 and crank 30. In FIG. 2C the plunger 9 is more depressed than the plunger 9 of FIG. 2B.

As mentioned above, a dispenser 1 transition from a closed to open configuration is opposed by a natural tendency to remain in and revert to a closed configuration. FIGS. 2A and 2B provide an illustration of such a natural tendency. The figures show a dispenser 1 with a retraction spring 19. FIG. 2A depicts the retraction spring 19 while the dispenser 1 is in a closed configuration. As shown FIG. 2B, the applicator 17 protrudes through the anterior opening 2 and partially compresses the retraction spring 19 against spring stop 20, which causes a continuous opposing force to the applicator 17 protrusion. Plunger 9 is activated by depression from its position in FIG. 2A to its position in 2B which plunger 9 depression also drives the applicator 17 protrusion, moves the reservoir body 27 and arm 16 toward the anterior, and suitably compresses the spring to its position in FIG. 2B. The force of compressed retraction spring 19 is constantly opposed to plunger 9 activation and applicator 17 protrusion.

Though the figures depict retraction spring 19 as the natural tendency, an internal compression spring is not the only means for inducing the aforementioned natural tendency. Such natural tendency may be invoked internally or externally through the use of magnets, elastics, rubbers, manual or any other attractive or repulsive force.

As mentioned above, until dispenser 1 is locked into the open configuration, the natural tendency will suitably invoke reversion to a closed configuration. The dispenser 1 of the present application typically uses a suitable latching means to lock the open configuration when the applicator 17 has been protruded sufficiently from the dispenser body 3. The latching means may remove the natural tendency or suitably counteract the force. FIGS. 2A and 2B provide illustrations of a latching means at work. FIG. 2B depicts an arm 16 extending from the reservoir body 27 that fixes to a ledge 12 notched into an inner wall of the body 3 just below the body 3 orifice 11. FIG. 2A shows this arm 16 contracted while the dispenser 1 is in a closed configuration. Application of an axial initiating force at the plunger 9 end, depresses the deactivated plunger 9 of FIG. 2A, and moves the arm 16 toward notched ledge 12 below orifice 11. FIG. 2B shows arm 16 levered against the ledge 12 such that compressed retraction spring 19 cannot expand to force the dispenser 1 to a closed configuration.

Though the figures depict extended arm 16 and ledge 12 as the latching mechanism, there are many other suitable latching means. This latching means might take the form of a hook, lever, constriction, latch, adhesive, friction, and by other means that would be appreciated by those skilled in the art.

The plunger 9 becomes an activated trigger when further depression accomplishes expulsion of contained substance from the exposed applicator 17 at the applicator tip 18. To prevent undesired and unintentional internal ejection of contained substance at the applicator tip 18, the plunger 9 is not used to eject substance until in the open configuration. FIGS. 2A and 2B provide an illustration of plunger 9 activation. As mentioned above, the deactivated plunger 9 of FIG. 2A may be depressed by an initiating force until extended arm 16 meets ledge 12 to lock the dispenser in its FIG. 2B configuration. Beginning at FIG. 2A, an initiating force applied to the butt of deactivated plunger 9 moves at least one of the reservoir body 27 and contracted arm 16 from a posterior position to an anterior position as seen in FIG. 2B. The retraction spring 19 compresses against spring stop 20, the cap 5 opens along hinge 13, and the applicator 17 protrudes from the body 3 through anterior opening 2. When locked in this open configuration, the plunger 9 is activated because further plunger 9 depression induces substance movement along applicator shaft 15 culminating with ejection through the applicator 17, suitably by way of the applicator tip 18.

A button 7 becomes an activated reversion switch when action upon it results in reversion from an open to closed configuration. A button 7 as a reversion switch is a suitable means for unlocking the open configuration. FIGS. 2A and 2B illustrate the activation of a button 7 as a reversion switch. In FIG. 2B, arm 16 interacts with ledge 12 just below the orifice 11 to prevent retraction spring 19 from expanding. The button 7 of FIG. 2B is activated because acting on it contracts arm 16 and allows retraction spring 19 to push the exposed applicator 17 back within the body to its FIG. 2A configuration. The button 7 in FIG. 2A is inactive because acting on it does not result in reversion.

Though the figures depict the button 7 accessible through the orifice 11 as a reversion switch, anything that releases the dispenser 1 latching means can be used as a reversion switch.

Figure 3:
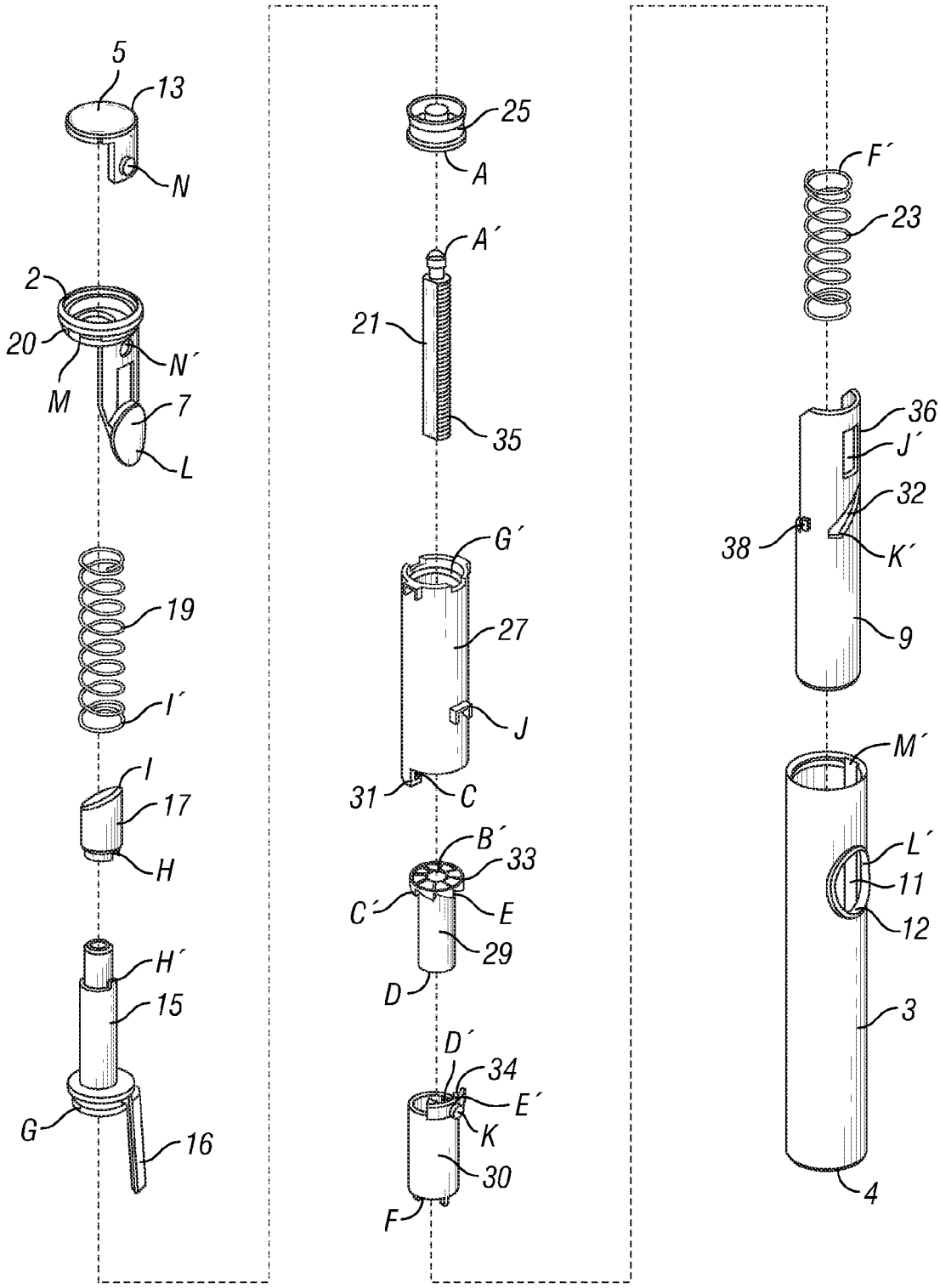
FIG. 3 is an exploded dispenser 1 of FIG. 1.

The dispenser 1 of the present application normally ejects a substance through the exposed applicator 17 at the applicator tip 18 after an impulse has sufficiently depressed a plunger and induced movement of a contained substance along an applicator shaft 15 between the applicator tip 18 and the chamber 28. Movement of said contained substance along the applicator shaft 15 may be realized by a piston, pump, suction, expansion, compression or otherwise as will be appreciated by those skilled in the art. FIG. 2B, 2C and FIG. 3 illustrate a typical dispensing process. If an axial impulse is suitably applied to the butt of the activated and partially depressed plunger 9 in FIG. 2B, the plunger 9 fully depresses to its active position in 2C. During depression of the plunger 9, the crank teeth 34 and driver teeth 33 interlock to change the idle crank 30 of FIG. 2B into the working crank 30 of FIG. 2C. Additionally, the active plunger 9 moves along plunger track 36 while the working crank 30 traverses crank path 32. At a later stage of the plunger 9 depression, idle driver 29 and plunger shaft 21 of FIG. 2B change to working driver 29 and plunger shaft 21 of FIG. 2C. After the crank teeth 34 and driver teeth 33 meet, the aforementioned movement of the working crank 30 along the crank path 32 axially torques the working driver 29 around drive path 31, which in turn drives the plunger shaft 21 into the reservoir body 27. As the driver 29 turns along drive path 31, cooperating groves 35 on the driver 29 and plunger shaft 21 interface to coaxially screw the plunger shaft 21 into the reservoir body 27. Each cycle of the activated plunger 9 drives the plunger shaft 21 incrementally further into the reservoir body 27. As a result, the idle piston 25 of FIG. 2B changes into the working piston of FIG. 2C. As the plunger shaft 21 incrementally enters the reservoir body 27 it pushes the piston 25 from the posterior of the chamber 28 toward the anterior of the reservoir body 27, which movement decreases the effective volume of the chamber 28, and pushes the contained substance along the applicator shaft 15 toward expulsion at the applicator tip 18.

As mentioned above, the dispenser 1 of the present invention contemplates that the amount of contained substance induced to move by a single plunger 9 depression may be set by the dispenser 1 manufacturer. The parameters of crank path 32 and the thread pitch of plunger shaft 21 determine the degree of rotation achieved by the crank 30 and therefore, the distance which plunger shaft 21 is screwed and the piston 25 is driven into the reservoir body 27. Knowing this distance, with the geometric configuration of the chamber 28 and the thread pitch of plunger shaft 21, allows the volume of substance expelled at the tip 18 during a single plunger 9 depression to be determined. Metered movement of substance is important because the manufacturer can predict the life of a dispenser 1 and adjust its retail stock accordingly (whether dispenser 1 is disposable or refillable). Moreover, metered movement of substance is important in that globbing, or over accumulation of substance at the tip 18 can more easily be avoided by the user.

As mentioned above, the dispenser 1 of the present invention suitably should not dispense substance through the applicator tip 18 while it is concealed within the dispenser 1. As shown in the figures, an axial initiating force applied to the deactivated plunger 9 of FIG. 2A will not induce ejection of substance from the applicator 17, even though a similarly applied impulse to activated plunger 9 of FIG. 2B does. This apparent discrepancy is a result of the plunger spring 23. For a dispenser 1 depicted by the figures, the plunger spring 23 is suitably stiffer than retraction spring 19. Therefore, when the two springs oppose each other, the retraction spring 19 compresses sufficiently to achieve the configuration of FIG. 2B before the plunger spring 23 compresses enough to accomplish expulsion of substance through applicator 17. Once locked into an open configuration of FIG. 2B, the plunger spring 23 opposes depression of the plunger 9 along the plunger track 36 to its active position in FIG. 2C. Because there are normally no means for locking the plunger spring 23 into a compressed state, the plunger spring 23 usually expands after a plunger 9 depressing impulse to cause reversion of the fully depressed plunger 9 of FIG. 2C to the partially depressed plunger 9 of FIG. 2B. In an alternative embodiment, arm 16 prevents the expulsion of substance while the applicator tip is concealed within dispenser 1. In this case, the distal end of contracted arm 16 within the body 3, abuts the internally housed edge of plunger 9, thereby preventing compression of plunger spring 23 while the dispenser is in the deactivated state illustrated by FIG. 2A. By way of the plunger 9 interaction with arm 16, the plunger 9 depression drives the reservoir body to the anterior of the body cavity 6, opens cap 5, and exposes the applicator tip 18 through anterior opening 2. Once the dispenser 1 attains an open configuration illustrated by FIG. 2B, arm 16 extends away from the internal edge of plunger 9 to interact with ledge 12 thereby locking the dispenser in position. Since the arm 16 no longer interacts with plunger 9, plunger spring 23 may be compressed by further plunger 9 depression and substance dispensed from the exposed applicator tip 18.

The dispenser of the present application has a suitably retractable applicator 17 which may electively be re-concealed after use. Upon completion of desired dispensing, the button 7 as an activated reversion means, may be selectively acted upon to invoke reversion to a closed configuration. FIGS. 2A and 2B provide an illustration of this type of reversion. The activated button 7 of FIG. 2B is accessible through orifice 11. FIG. 2B shows the arm 16 extended to interact with ledge 12 just below orifice 11 to lock dispenser 1 in the functional configuration. When the button 7 of FIG. 2B is depressed within orifice 11, the button 7 causes arm 16 to contract and dispenser 1 reverts to its FIG. 2A configuration. After arm 16 contracts, the retraction spring 19 expands, the applicator 17 enters the body 3 through anterior opening 2, the cap 5 closes along hinge 13, reservoir body 27 and arm 16 moves from their anterior position to their posterior positions, and plunger 9 and its internal components extend further from posterior opening 4.

Though the figures depict a flexible cap 5 that opens along hinge 13, other types of coverings work. For example, the cap 5 may slide to the side in order to reveal anterior opening 2 rather than open along a hinge 13. In another example, cap 5 may rotate around a pivot to reveal anterior opening 2. Various other means for opening are contemplated and will be appreciated by those skilled in the art.

FIG. 3 is an exploded view of the dispenser 1 depicted in the figures. FIG. 3 is an inventory of parts, and a construction diagram for the dispenser 1 of FIGS. 1A, 1B, 1C, 2A, 2B and 2C. The components generally fit together by following the dashed line from the top left to the bottom right of the FIG. 3. More specifically, the piston 25 couples with plunger shaft 21 (A to A') and together the piston 25 and plunger shaft 21 together merge approximately coaxially with the reservoir body 27 anterior, such that the piston 25 defines an inner wall of chamber 28 and plunger shaft 21 is extended at the reservoir body 27 rear. The exposed end of the plunger shaft 21 suitably inserts coaxially into the driver 29 (B to B') by way of cooperating groves 35 at the plunger shaft 21 and driver 29 interface. The driver 29 is positioned in the reservoir body 27 after the piston 25 so that the driver teeth 33 are partially exposed at drive path 31 (C to C'). The anterior portion of the driver 29 is coaxially inserted into the female end of the crank 30 so that the crank teeth 34 are capable of meeting the exposed driver teeth 33 (D to D'). The driver teeth 33 and crank 30 teeth 33 (E to E') only interact when plunger 9 is depressed to induce expulsion of contained substance. The crank 30 may then be inserted into plunger spring 23 (F to F'). After substance has been loaded into chamber 28, the arm 16 and applicator shaft 15 are positioned at the anterior of reservoir body 27 to close chamber 28 (G to G'). The applicator shaft 15 is inserted into the female receptor of tip 17 (H to H') after which the applicator tip 18 and applicator shaft 15 are inserted into retraction spring 19 (I to I'). The anterior reservoir body 27 posterior and accompanying components described above, are placed into the plunger cavity 8 such that reservoir body 27 and plunger 9 interact at the plunger track 36 (J to J'), and such that the crank 30 interacts with the crank path 32 (K to K'). The plunger 9, reservoir body 27, and accompanying components described above, are inserted into the body hollow 6, with the plunger 9 extended from anterior opening 4 until nub 38 prevents the plunger 9 from exiting the body hollow 6 from the anterior opening 4. The spring stop 20 and button 7 are positioned at the body 3 anterior (M to M') such that the button 7 is accessible through orifice 11 (L to L')

and such that the anterior opening 2 is formed. Finally, the cap 5 and hinge 13 are positioned to cover anterior opening 2 (N to N').

A first alternate embodiment of the present application is the dispenser 101. Dispenser 101 is functionally similar to the previous embodiment 1 contemplated by FIGS. 1-3, with variations as set forth below. More specifically, aspects and components for dispenser 101 are similar to the corresponding ones of the earlier described preferred embodiment 1.

Figure 4:
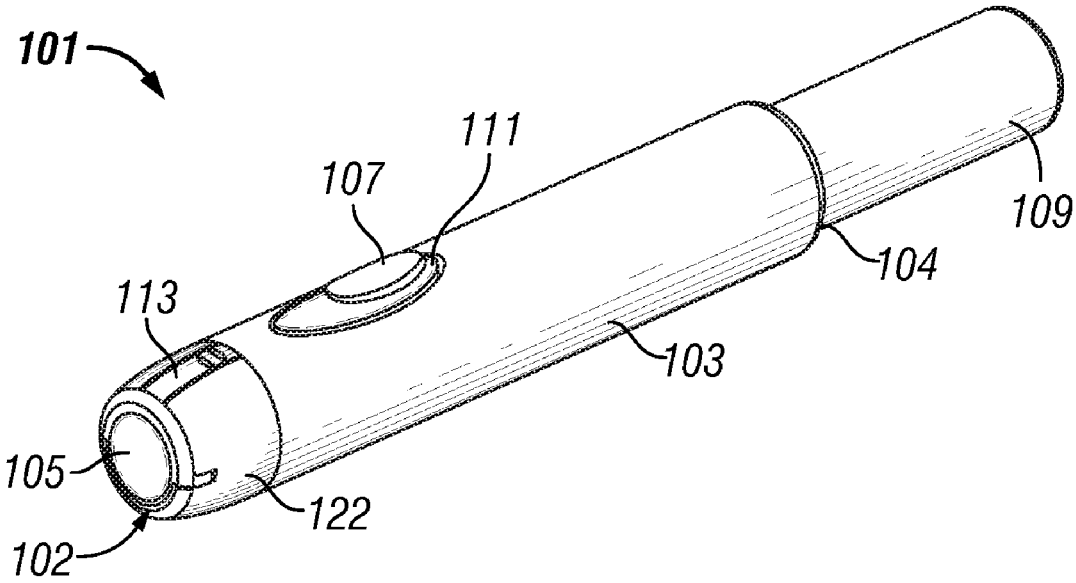
FIG. 4 is a perspective view of an second embodiment of dispenser 101 in a closed configuration.

FIG. 4 depicts a dispenser 101 in a closed configuration. Similar to FIG. 1A, FIG. 4 shows a dispenser body 103 featuring a slit 111 preferably situated around a lever 107, which lever 107 suitably defines an excrescence on the dispenser body 103. FIG. 4 also shows the anterior of the dispenser body 103 suitably occupied by a cap 105 and cap housing 122 which may variably seal the anterior opening 102 of the dispenser 101. The posterior of the body 103 is suitably occupied by a plunger 109 that typically coaxially merges into (or with) the body 103 by way of the posterior opening 104. Similar to the corresponding components of FIG. 1A, in FIG. 4, the plunger 109 represents a deactivated trigger and the anterior opening 102 represents an exit location for the applicator 117. As detailed below, the lever 107 is an inactive reversion means, meaning that it may function to release the applicator 117 from a fixed extended position, allowing it to be selectively retracted by the user into the body 103 of the dispenser 101. Also detailed below, in FIG. 4 the cap housing 122, body 103, and plunger 109 have various internally concealed components.

Figure 5:
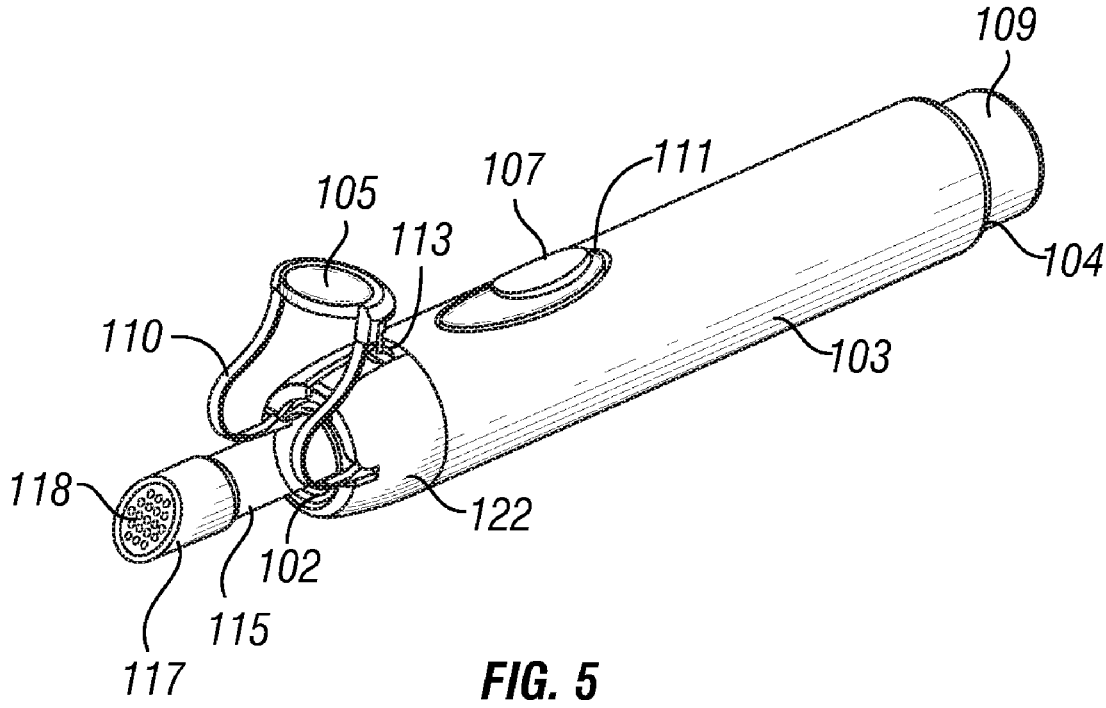
FIG. 5 is a perspective view of dispenser 101 of FIG. 4 in an open configuration.

FIG. 5 typifies a dispenser 101 in an open configuration. The figure illustrates a cap 105 held open and away from anterior opening 102 by a pair of rigid, yet flexible, cap shoots 110 and a flexor 113. Similar to FIG. 2B, FIG. 5 also depicts the protrusion of an applicator 117 through the exposed anterior opening 102. An activated lever 107 is accessible at slit 111, and a partially depressed plunger 109 extends from the posterior opening 104. In FIG. 5, the anterior opening 102 is the exit location for applicator 117. As detailed further below, the lever 107 is suitably an activated reversion means. Also detailed below, in FIG. 5 the cap housing 122, body 103 and plunger 109 have various internal components.

The dispenser 101 of the present application has a suitably retractable applicator 117 which may be electively exposed for applicator tip 118 use. Similar to the earlier preferred embodiment 1, elective transition from a closed to an open configuration is usually achieved through application of an initiating force which suitably activates the plunger 109 as a trigger, exposes anterior opening 102, and protrudes the applicator 117 from the dispenser 101. In most instances, the acting force on the plunger 109 will be generated by the user manually, for instance by a thumb or finger. The dispenser 101 typically has a natural tendency to revert from an open to a closed configuration. As discussed further herein, during transition from closed to open configurations, this tendency is normally continuously opposed to applicator 117 protrusion and plunger 109 activation. However, once the plunger 109 has been activated, the applicator 117 is suitably locked in external position and natural reversion to a closed configuration is prevented. Also discussed further herein, once the dispenser 101 is suitably locked into an open configuration, the lever 107 suitably becomes an activated reversion means which may electively be acted upon to release the lock, thereby enabling the aforementioned natural tendency to actuate reversion to a closed configuration. FIGS. 4 and 5 taken together may help visualize this transition. Referring to these two figures, when an external axial force is applied to the butt of the plunger 109 in FIG. 4, such force depresses the plunger 9, extrudes cap shoots 110 from cap housing 122, releases the cap 105 along flexor 113, and projects applicator 117 from the anterior opening 102. Once the force moves the plunger 109 to its partially depressed position in 5, plunger 109 and lever 107 are activated and the configuration is usually locked in place. At this point, reversion to the closed state of FIG. 4 normally can only be attained through interaction with lever 107. See the discussion below for more details.

During expulsion of contained substance through an exposed applicator tip 118, the dispenser 101 is in an open and dispensing configuration. A dispenser 101 in such an open and dispensing configuration has components in roughly the same relative positions as that of FIG. 5, but the plunger 109 is suitably depressed fully toward the body 103. As a result, the depressed and active plunger 109 may be used as an active trigger, to forcibly eject cosmetic substance, is typically from an applicator tip 118 of the dispenser 101.

Transition from an open to an open and dispensing configuration, followed by suitable reversion, is usually achieved by way of a motive force placed upon the contained substance, that is caused by the plunger 109 being fully depressed and active. A fully depressed and active plunger 109 typically results from axial impulse on the end of the activated plunger 109, as shown in FIG. 5. As discussed in more detail below, this impulse induces metered dispensing of a contained substance from the exposed applicator tip 118. Applicator 117 may feature at least one, or a plurality of orifices through which substance may be expelled. Dissipation of the aforementioned impulse results in reversion of the plunger 109 from fully to partially depressed and suitably ends dispensing of substance until a new impulse is triggered. Usually there is no mechanism to lock the dispenser in an open and dispensing configuration. When an external axial impulse is applied to the butt of the plunger 109 in FIG. 5, this impulse usually fully depresses the plunger 109 which induces metered expulsion of a contained substance from applicator tip 118. Upon dissipation of said axial impulse, suitably the fully depressed plunger 109 automatically returns to its position in FIG. 5. A typical use cycle would entail impulsive depression of the plunger 109 from its partially depressed position in FIG. 5 to a fully depressed position, followed by reversion to its partially depressed position in FIG. 5. Normally, the cosmetic dispensing feature of dispenser 101 is accomplished by the plunger 109 being cycled repeatedly to cause sufficient accumulation of contained substance at the applicator tip 18, where a user would then apply the substance to the lips, eyes, face, or the like.

Still referring to FIGS. 4 and 5, and similar to the corresponding elements in the earlier preferred embodiment 1 of the present invention, the specifics of the applicator 117 (usually including the applicator shaft 115 and applicator tip 118) depend on the type of substance and the nature of the dispenser 101 purpose. In the accompanying figures, the applicator tip 118 is a hollow truncated cylinder with an angled cylindrical section as the applicator tip 118 surface, as one might see in a lip gloss applicator. In some instances, however, the applicator tip 118 may just be an orifice or other type of opening through which a substance may be discharged. In another instance, the applicator tip 18 may be a membrane through which substance may be expelled. In yet another instance, the applicator tip 118 may be some type of rigid member to which expelled substances may adhere while awaiting application (e.g., a brush for mascara).

Figure 7A:
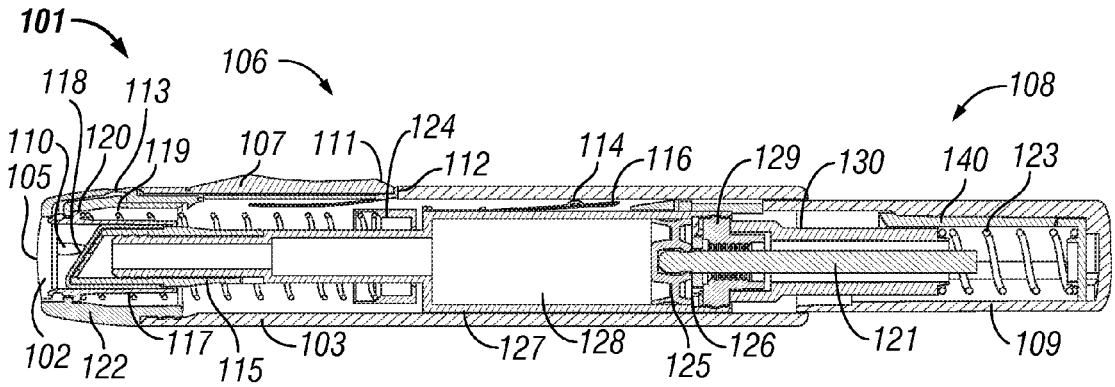
FIG. 7A is a longitudinal cross-section of the dispenser 101 of FIG. 4.

FIG. 7A is a longitudinal cross-section of the dispenser 101 of FIG. 4. The figure shows a dispenser 101 with a closed cap 105 and body hollow 106 which houses the applicator 117 including the applicator shaft 115 and applicator tip 118, the retraction spring 119, the cap shoots 110, the shoot press 124, the contracted arm 116, ledge 112, a movable reservoir body 127 (which contains the piston 125, and part of the plunger shaft 121), resistor 126, drive gear 129, and crank 130. The figure also shows a dispenser with a plunger cavity 108 that houses the plunger spring 123, the crank housing 140, and most of the plunger shaft 21, drive gear 29 and crank 30. In FIG. 7A the plunger 109 is fully extended away from the body 103 and the internal components of the body hollow 106 are toward the body 103 posterior. The reservoir body 127 and its chamber 128 are an enclosure configured to contain cosmetic substances, which are usually fluid or powder in nature. Typical substances include, but are not limited to, lipstick, mascara, lip gloss, blemish remover, concealers, eyeliners, and the like as will be appreciated by those skilled in the industry. The applicator shaft 115 suitably defines an avenue or channel between the applicator tip 118 and the chamber 128 containing substance. In other words, the applicator shaft 115 and chamber 128 are suitably in fluid connection with one another.

Figure 7B:
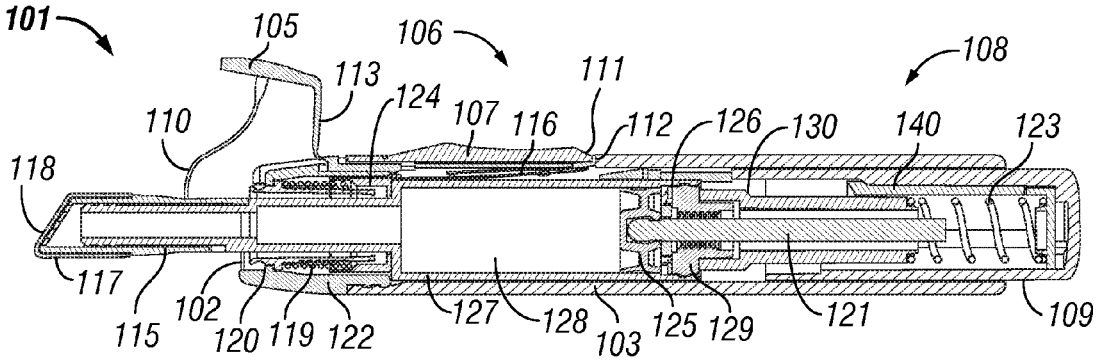
FIG. 7B is a longitudinal cross-section of the dispenser 101 of FIG. 5.

FIG. 7B is a longitudinal cross-section of the dispenser 101 of FIG. 5. The figure illustrates; a cap 105 held open and away from anterior opening 102 by a pair of rigid, yet flexible, cap shoots 110 and a flexor 113; and, applicator 117 (which usually includes applicator tip 118 and applicator shaft 115) protruding through exposed anterior opening 102. The body hollow 106 houses the retraction spring 119 which is compressed against the spring stop 120; the shoot press 124 which has pushed the cap shoots 110 through the cap housing 122; the arm 116 extended to the ledge 112; and the reservoir body 127, which is locked in its position and which contains the piston 125 and part of the plunger shaft 121, resistor 126, drive gear 129, and crank 130. The figure also shows a dispenser 101 with a plunger cavity 108 that houses the plunger spring 123, idle plunger shaft 121, resistor 126, drive gear 29, and crank 30. In FIG. 7B the activated plunger 109 is more depressed toward the body 103 than the deactivated plunger 109 of FIG. 7A and the internal components of the body 3 hollow 6 are more toward the body 103 anterior.

Figure 7C:
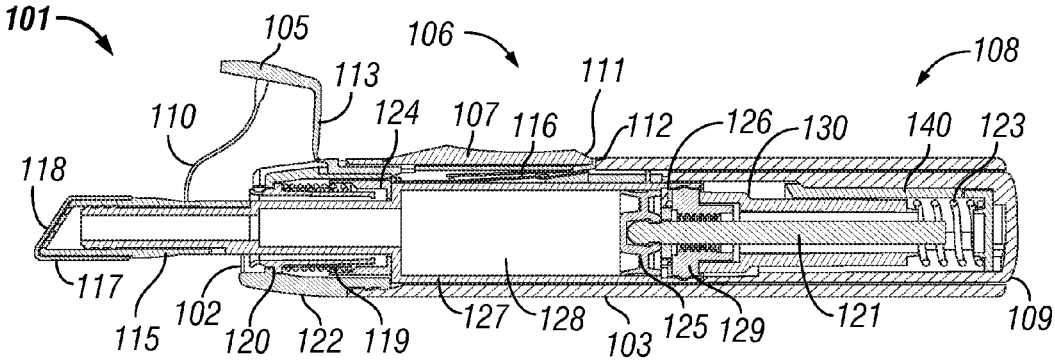
FIG. 7C is a longitudinal cross-section of the dispenser 101 in an open and dispensing configuration, with applicator 117 exposed, and with a plunger 109 fully depressed.
Figure 8:
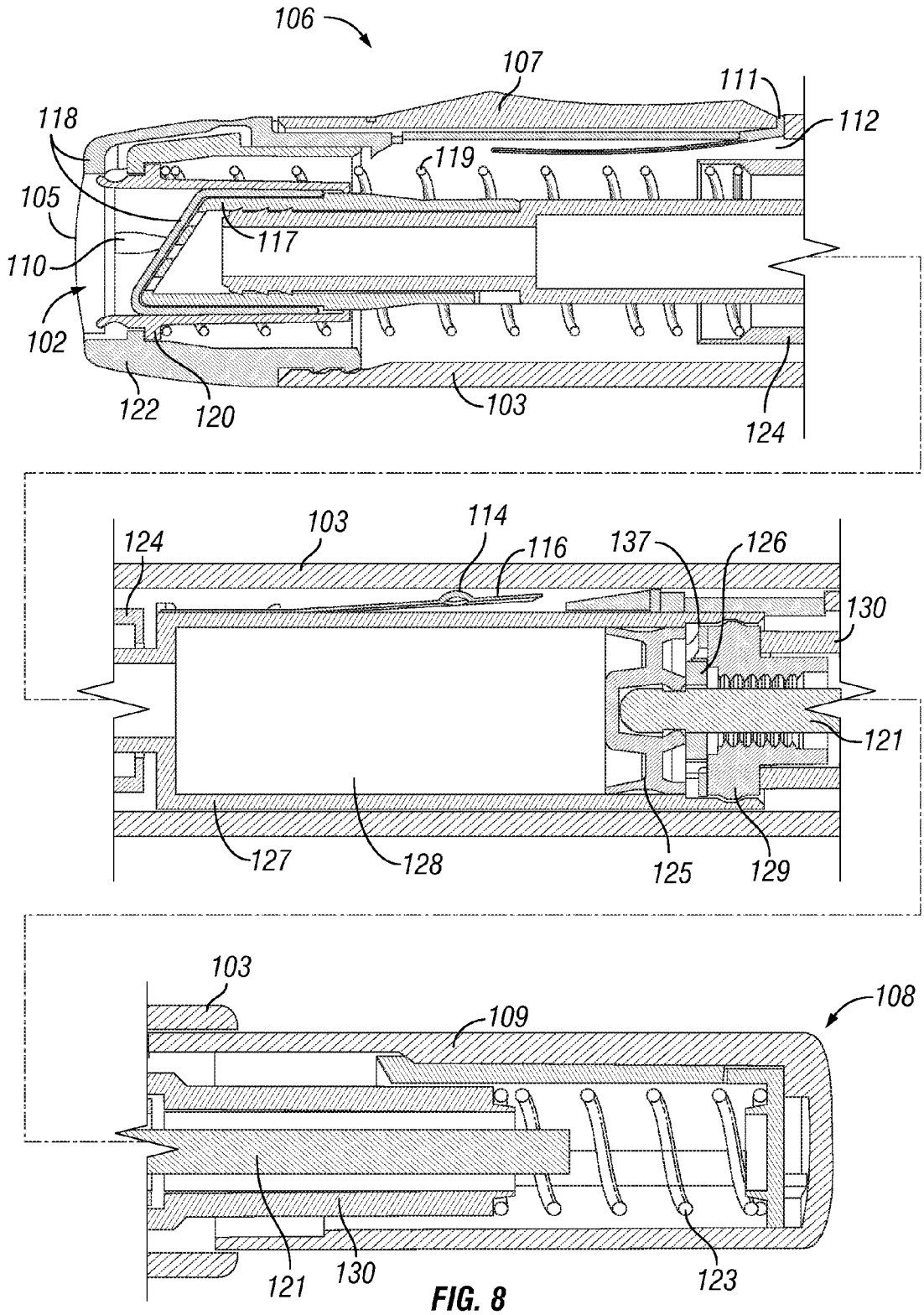
FIG. 8 is an enlarged longitudinal cross-section of the dispenser 101 of FIG. 4 in a closed configuration.

FIG. 7C is a longitudinal cross-section of the dispenser 101 in a open and dispensing configuration. FIG. 7C is the same as FIG. 7B except the figure shows a dispenser 101 with a fully depressed plunger 109 and plunger cavity 108 which houses the compressed plunger spring 23, the working plunger shaft 121, resistor 126, piston 125, drive gear 129 and crank 130. In FIG. 7C the plunger 109 is more depressed than the plunger 109 of FIG. 7B.

As mentioned above, a dispenser 101 transition from a closed to open configuration is opposed by a natural tendency to remain in and revert to a closed configuration. FIGS. 7A and 7B provide an illustration of such a natural tendency. These figures show a dispenser 101 with a retraction spring 119. FIG. 7A depicts the retraction spring 119 while the dispenser 109 is in a closed configuration. Transitioning from the dispenser 101 of FIG. 7A to that shown in FIG. 7B, after the cap 105 has opened, the applicator 117 protrudes through the anterior opening 102 and partially compresses the retraction spring 119 against spring stop 120, which causes a continuous opposing force to the applicator 117 protrusion. Plunger 109 is activated by depression from its position in FIG. 7A to its position in 7B which plunger 109 depression accomplishes at least the following: (1) moves the reservoir body 127, shoot press 124, and arm 16 toward the anterior; (2) extrudes the cap shoots 110 through cap housing 122 to open cap 105, and guided by flexor 113; (3) drives the applicator 117 protrusion; and, (4) suitably compresses the spring to its position in FIG. 7B. The force of compressed retraction spring 119 is constantly opposed to plunger 109 activation and applicator 117 protrusion.

Though the figures depict retraction spring 119 as the natural tendency, an internal compression spring is not the only means for inducing the aforementioned natural tendency. Such natural tendency may be invoked internally or externally through the use of magnets, elastics, rubbers, manual or any other attractive or repulsive force.

As mentioned above, until dispenser 101 is locked into the open configuration, the natural tendency will suitably invoke reversion to a closed configuration. Similar to the earlier disclosed embodiment 1, the dispenser 101 of the present application typically uses a suitable latching means to lock the open configuration when the applicator 117 has been protruded sufficiently from the anterior opening 102. The latching means may remove the natural tendency or suitably counteract the force. Similar to FIGS. 2A and 2B, FIGS. 7A and 7B provide illustrations of a latching means in operation. FIG. 7B depicts an arm 116 extending from the reservoir body 127 that fixes to a ledge 112 notched into an inner wall of the body 103 just below the slit 111. FIG. 7A shows this arm 116 contracted while the dispenser 101 is in a closed configuration. Application of an axial initiating force at the plunger 109 butt, depresses the deactivated plunger 109 of FIG. 7A, and moves the arm 116 toward ledge 112 below slit 111. FIG. 7B shows arm 116 levered against the ledge 112 such that compressed retraction spring 119 cannot expand to force the dispenser 101 to a closed configuration.

Though the figures depict extended arm 116 and ledge 112 as the latching mechanism for dispenser 101, there are many other suitable latching means. This latching means might take the form of a hook, lever, constriction, latch, adhesive, friction, and by other means that would be appreciated by those skilled in the art.

The plunger 109 becomes an activated trigger when further depression accomplishes expulsion of contained substance from the exposed applicator 117 at the applicator tip 118. To prevent undesired and unintentional internal ejection of contained substance at the applicator tip 118, the plunger 109 is not used to eject substance until dispenser 101 is in the open configuration. FIGS. 7A and 7B provide an illustration of plunger 109 activation. As mentioned above, the deactivated plunger 109 of FIG. 7A may be depressed by an initiating force until extended arm 116 meets ledge 112 to lock the dispenser in its FIG. 7B configuration. Beginning at FIG. 7A, an initiating force applied to the butt of deactivated plunger 109 moves at least one of the reservoir body 127, shoot press 124, and contracted arm 116 from a posterior position to an anterior position as seen in FIG. 2B. During depression, the retraction spring 119 compresses against spring stop 120, the cap shoots 110 extrude out of the cap housing 122, the cap shoots 110 force open the cap 105 while the flexor 113 guides the cap 105 away from anterior opening 102, and the applicator 117 (which usually includes applicator shaft 115 and applicator tip 118) protrudes from the body 103 and cap housing 122 through anterior opening 2. When locked in this open configuration, the plunger 109 is activated because further plunger 109 depression induces substance movement along applicator shaft 115 culminating with ejection through the applicator 117, suitably by way of the applicator tip 118.

A lever 107 becomes an activated reversion switch when action upon it results in reversion from an open to closed configuration. A lever 107 as a reversion switch is a suitable means for unlocking the open configuration. FIGS. 7A and 7B illustrate the activation of a lever 107 as a reversion switch. In FIG. 7B, arm 116 interacts with ledge 112 just below the slit 111 to prevent retraction spring 119 from expanding from its compressed state. While arm 116 is interacting with ledge 112, lever 107 deflection is required to dissociate the arm 116 from the ledge 112 and thereby effectuate reversion of dispenser 101 to a closed configuration. Importantly, the protuberance 114 is usually designed to allow smooth transition from a closed dispenser 101 configuration to an open configuration and vice versa. In other words, the protuberance 114 does not usually extend distally from the arm 116 to a degree or to the extent that would allow the protuberance 114 to interact with the other internal components or features of the dispenser 101 in a manner that blocks or hinders transition between dispenser 101 configurations. Rather, the protuberance interacts with the internal surface of body 103 to prevent the distal end of arm 116 from snagging thereon while contracted. In the open configuration, the lever 107 of FIG. 7B is an activated reversion switch because acting on it contracts arm 116, and allows retraction spring 119 to push the exposed applicator 117 (which usually features an applicator shaft 115 and an applicator tip) back within the body to the FIG. 7A configuration. The lever 107 in FIG. 7A is inactive because acting on it does not result in reversion. Finally, as mentioned above, lever 107 suitably defines an excrescence on the body 103 in order that lever 107 may be more readily identified whether by sight or feel. However, the degree or extent of desirable excrescence will vary and change depending on desired dispenser 101 use and in some instances a lever 107 may be flush with the body 103 surface and not define an excrescence at all. Such details will be apparent to those skilled in the art. Though the figures depict the lever 107 in association with slit 111 as a reversion switch, anything that releases the dispenser 101 latching means may be used as a reversion switch.

Figure 9:
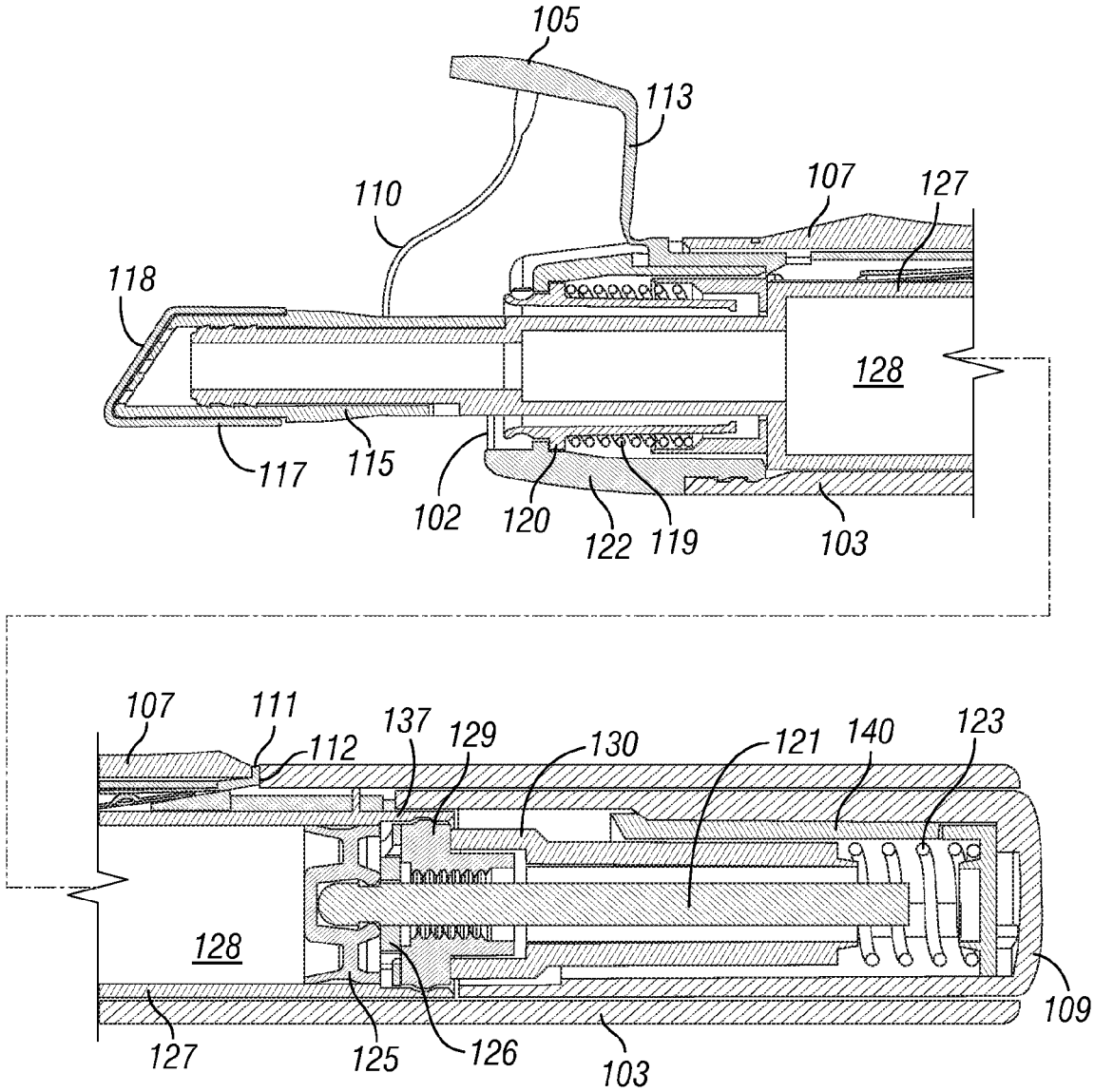
FIG. 9 is an enlarged longitudinal cross-section of the dispenser 101 of FIG. 5 in an open and dispensing configuration, with applicator 117 exposed, and with a plunger 109 fully depressed.

Another feature of the dispenser 101 is the cap 105 which, in conjunction with an elastomeric spring stop 120 and the applicator shaft 115, electively seals or unseals the anterior opening 102, typically by way of a substantially air or water tight pocket. FIGS. 4, 5, 7A and 7B provide an illustration of the cap 105 in operation. While dispenser 101 is in a closed configuration like that of FIGS. 4 and 7A, the cap 105 suitably seals the anterior opening 102 of the dispenser 101 as follows: the retraction spring 119 is fully extended and preferably forces the shoot press 124 to abut the reservoir body 127 at one end, and the presses the spring stop against cap housing 122 on the other end; the shoot press 124 suitably pulls the cap shoots 110 taut, which tension usually interlocks the cap 105 with the cap housing 122 and secures the cap 105 over the anterior opening against the anterior of spring stop 120; the tension on the cap shoots 110 between the shoot press 124 and the cap 105 suitably squeezes the spring stop 120 between the cap 105 and the cap housing 122 thereby forcing deformation of the elastomeric spring stop 120 until the anterior opening 102 is substantially air or water tight; and finally, at the posterior of the spring stop 120, the applicator shaft 115, which is coaxial to the spring stop 120 and which has an increasing diameter toward the applicator 117, forces deformation of the posterior of the spring stop 120 by way of its increasing diameter relative to the diameter of the spring stop 120 (see FIG. 7A). Accordingly, a substantially air or water tight pocket is created between the cap, the spring stop 120 and the applicator shaft 115. Other sealing means preferably may be placed throughout the dispenser 101 to effectuate an optional air or water tight dispenser 101. As illustrated by FIGS. 5 and 7B, to unseal the cap 105, plunger depression moves the reservoir body 127 and shoot press 124 internally toward the anterior opening 102, the shoot press forces the cap shoots 110 through the cap housing 122, and the cap 105 is forced off of the anterior opening 102 by the cap shoots 110 and drawn away by the flexor 109. Also, as the tip 118 is exposed from anterior opening 102, the decreasing diameter of the applicator shaft 115 relative to the posterior of the spring shoot 120 permits the elastomeric spring shoot 120 to return to equilibrium (See FIG. 7B or 7C). A substantially air or water tight pocket at the anterior opening is useful to prevent contamination, corruption, or dehydration/drying of the tip 118 and contained substance. Additionally, attached to distal end of the flexor 113 is a hook which interacts with cap housing 122 to extend the useful life the seal. The flexor 113 slides forward with the catch shoots 110 when the plunger 109 is pressed, and the hook stops at the base of the cap housing 122 when the cap is open as illustrated in FIGS. 7B, 7C and 9. This feature typically allows the cap 105 to come down evenly on the seal surface of spring stop 120 without applying to much pressure to one side of the elastomeric spring stop 120 and possibly deforming it over time.

Figure 6:
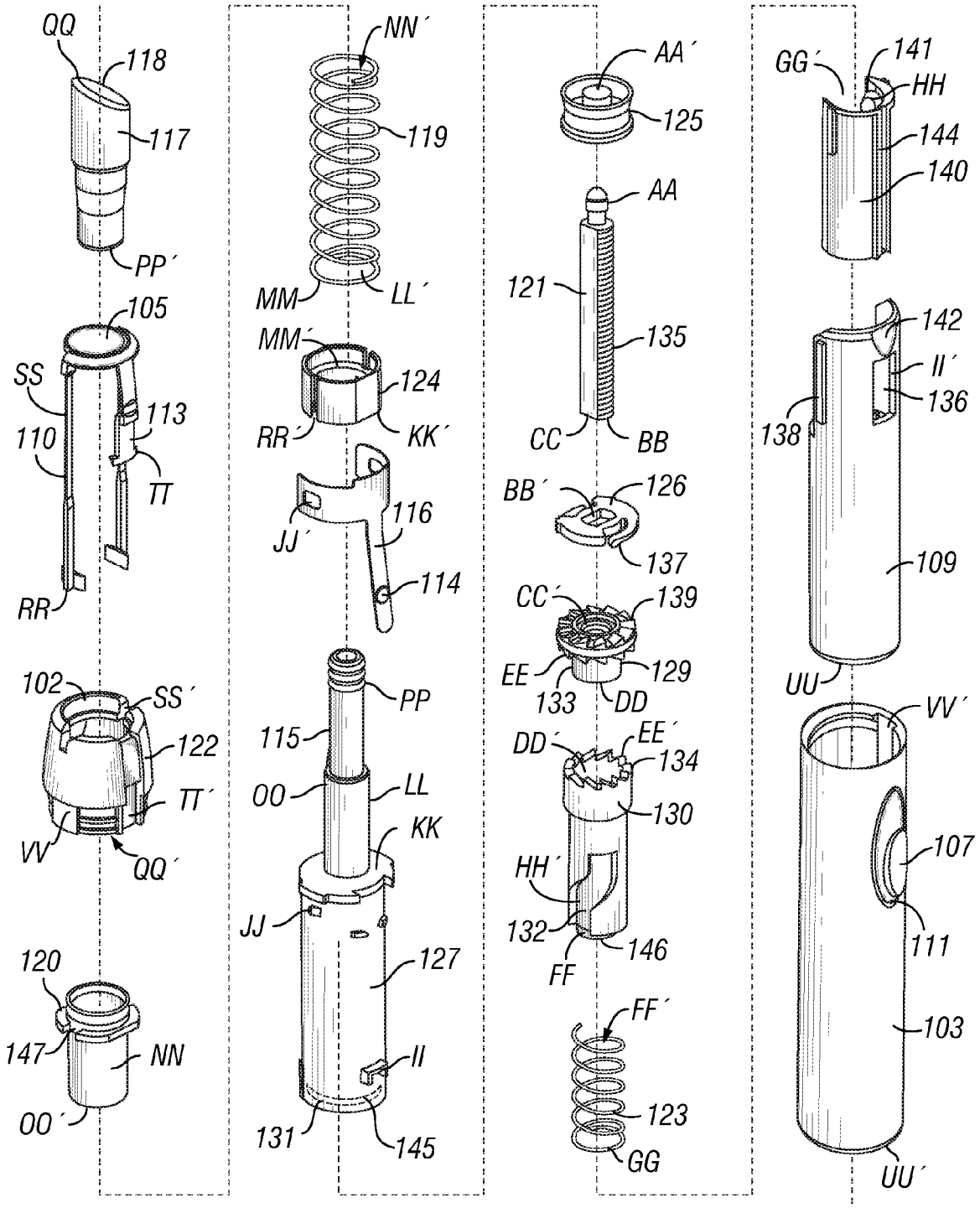
FIG. 6 is an exploded dispenser 101 of FIGS. 4 and 5.

The dispenser 101 of the present application normally ejects a substance through the exposed applicator 117 at the applicator tip 118 after an impulse has sufficiently depressed a plunger 109 and induced movement of a contained substance along an applicator shaft 115 between the applicator tip 118 and the chamber 128. Movement of said contained substance along the applicator shaft 115 may be realized by a piston, pump, suction, expansion, compression or otherwise as will be appreciated by those skilled in the art. As described below, FIG. 7B, 7C and FIG. 6 illustrate a typical dispensing process for the dispenser 101.

If an axial impulse is suitably applied to the butt of the activated plunger 109 shown in FIG. 7B, the plunger 109 further depresses until it is fully depressed as depicted by FIG. 7C, after which the plunger 109 reverts to its FIG. 7B position. During this complete depression and reversion of the plunger 109, the idle crank 130 of FIG. 7B changes into the working crank 130 of FIG. 7C usually as follows: (1) the crank housing 140 and associated crank guide 141 suitably advance toward the reservoir body 127; (2) the crank guide 141 traverses crank path 132 which axially torques the crank 130 relative to the reservoir body 127 because grip 144 interacts with channel 143 to prevent the crank housing 140 and associated crank guide 141 from axially rotating relative to the reservoir body 127; (3) the crank housing 140 and associated crank guide 141 suitably retreat away from the reservoir body 127; and, (4) the crank guide 141 reverses crank path 132 which axially torques the crank 130 in the opposite direction relative to the reservoir body 127 because grip 144 and channel 143 prevent the crank housing 140 and associated crank guide 141 from axially rotating relative to the reservoir body 127.

At the immediate anterior of the reservoir body 127 is housed the driver 129 and resistor 126 which are suitably held in longitudinal position relative to the reservoir body 127 by the drive path 131 and resistor path 145 respectively. The resistor 126 is fixed axially (may not traverse resistor path 145), while the driver may rotate axially (may traverse drive path 131). In other words, the driver 129, but not resistor 126, may rotate axially relative to the reservoir body 127, while both suitably do not move longitudinally from their position at the anterior of the reservoir body 127. The driver 129 has driver teeth 133 on its lower side which interlock with the crank teeth 134 while the crank guide 141 is traversing crank path 132 during activated plunger 109 depression. The driver teeth 133 and crank teeth 134 functionally disengage while the crank guide 141 is reversing crank path 132 during dispenser reversion from an open and dispensing configuration (FIG. 7C) to an open configuration (FIG. 7B). A working crank 130 torques the driver 129 relative to the reservoir body 127 and resistor 126 as the crank guide 141 traverses crank path 132 because the crank teeth 134 and driver teeth 133 are suitably interlocked, thereby inducing driver 129 rotation simultaneously and to the same degree as the crank 130. Though the crank 130 rotates in the opposite direction as the crank guide 141 reverses crank path 132, the driver 129 does not, because usually the crank teeth 134 and driver teeth 133 are functionally disengaged and because of a resister 126. The resister 126 sits adjacent to the driver 129 in resistor path 145. The resistor 126 typically features resister digits 137 that interact with digit grips 139 on the facing surface of the driver 129 to allow the driver 129 to rotate simultaneously with the crank 130 around driver path 131 as crank guide 131 traverses crank path 132, but to disallow driver 129 rotation in the opposite direction as crank guide reverses crank path 132. Consequently, as dispenser 101 reverts to its open configuration, crank teeth 134 and driver teeth 133 may suitably slide past each other and reset for subsequent depression of the plunger 109 and associated driver 129 rotation. Though the figures depict driver teeth 133 and crank teeth 134 whose profiles are cooperating right triangles, those skilled in the art will know various other mechanisms for accomplishing the same task. Though the resistor 126 features digits 137 which are bendable appendages which interact with grips 139 having a profile of a right triangle, those skilled in the art will know various other mechanisms for accomplishing the same task.

A rotating driver 129 is a working driver 129 because as it rotates, cooperating grooves 135 on the driver 129 and plunger shaft 121 interface, interact to coaxially screw the plunger shaft 21 into the reservoir body 127. Because resister 126 only permits driver 129 rotation in one direction, the plunger shaft 121 is not suitably unscrewed from its position within the reservoir body 127. Each repeated depression of the activated plunger 109 drives the plunger shaft 121 incrementally further into the reservoir body 127. As a result, the idle piston 125 of FIG. 7B changes into the working piston of FIG. 7C because the piston moves incrementally further into the reservoir body 127. As the plunger shaft 121 is incrementally driven into the reservoir body 127, it pushes the piston 125 from the posterior of the chamber 128 toward the anterior of the reservoir body 127, thereby decreasing the effective volume of the chamber 128, and at the same time, moving the contained substance along the applicator shaft 115 toward expulsion at the applicator tip 118.

As mentioned above, the dispenser 101 of the present invention contemplates that the amount of contained substance induced to move by a single plunger 109 depression may be set by the dispenser 101 manufacturer. The parameters of crank path 132 and the pitch of plunger shaft 121 determine the degree of rotation achieved by the crank 130 and therefore, the distance which plunger shaft 121 is screwed and the piston 125 is driven into the reservoir body 127. Knowing this distance, with the geometric configuration of the chamber 128 and the thread pitch of plunger shaft 121, allows the volume of substance expelled at the tip 118 during a single plunger 109 depression to be determined. Metered movement of substance is important because the manufacturer can predict the life of a dispenser 101 and adjust its retail stock accordingly (whether dispenser 101 is disposable or refillable). Moreover, metered movement of substance is important in that globbing, or over accumulation of substance at the tip 118 can more easily be avoided by the user.

As mentioned above, the dispenser 101 of the present invention suitably should not dispense substance through the applicator tip 118 while it is concealed within the dispenser 101. As shown in the figures, an axial initiating force applied to the deactivated plunger 109 of FIG. 7A will not induce ejection of substance from the applicator 117, even though a similarly applied impulse to activated plunger 109 of FIG. 7B does. This apparent discrepancy is a result of the plunger spring 123. For a dispenser 109 depicted by the figures, the plunger spring 123 is suitably stiffer than retraction spring 119. Therefore, when the two springs oppose each other, the retraction spring 119 compresses sufficiently to achieve the configuration of FIG. 7B before the plunger spring 123 compresses enough to accomplish expulsion of substance through applicator 117. Once locked into an open configuration of FIG. 7B, the plunger spring 123 opposes depression of the plunger 109 along the plunger track 136 to the open and dispensing position in FIG. 7C. Because there are normally no means for locking the plunger spring 123 into a fully compressed state, the plunger spring 123 usually expands after a plunger 109 depressing impulse, which thereby causes reversion of the fully depressed plunger 109 of FIG. 7C to the partially depressed plunger 109 of FIG. 7B. In an alternative embodiment, arm 116 prevents the expulsion of substance while the applicator tip 118 is concealed within dispenser 101. In this case, the distal end of contracted arm 116 within the body 103, abuts the internally housed edge of plunger 109, thereby preventing compression of plunger spring 123 while the dispenser is in the deactivated state illustrated by FIG. 4. By way of the plunger 109 interaction with arm 116, the plunger 109 depression drives the reservoir body to the anterior of the body cavity 106, opens cap 105, and exposes the applicator tip 118 through anterior opening 102. Once the dispenser 101 attains an open configuration illustrated by FIG. 5, arm 116 extends away from the internal edge of plunger 109 to interact with ledge 112 thereby locking the dispenser in position. Since the arm 116 no longer interacts with plunger 109, plunger spring 123 may be compressed by further plunger 109 depression and substance dispensed from the exposed applicator tip 118.

The dispenser 101 of the present application has a suitably retractable applicator 117 (which usually features an applicator shaft 115 and applicator tip 118) which may electively be re-concealed after use. Upon completion of desired dispensing, the lever 107 as an activated reversion means may be selectively acted upon to invoke reversion to a closed configuration. FIGS. 7A and 7B provide an illustration of this type of reversion. The activated lever 107 of FIG. 7B is accessible at slit 111. FIG. 7B shows the arm 116 extended to interact with ledge 112 just below orifice 111 to lock dispenser 101 in the open configuration. When the lever 107 of FIG. 7B is deflected through slit 111, the lever 107 causes arm 116 to contract and dispenser 101 reverts to its FIG. 7A configuration. After arm 116 contracts, the retraction spring 119 expands, the applicator 117 (which usually features an applicator shaft 115 and applicator tip 118) enters the body 103 through anterior opening 102, the shoot press moves toward the anterior of the body 103 which draws the cap shoots 110 through the cap housing 122 into the body hollow 106, the cap 105 is suitably guided by flexor 113 to cap housing 122, reservoir body 127 and arm 116 move from their anterior position to their posterior positions, the plunger 109 and its internal components extend fully from the dispenser body 103, and finally the cap 105 seals anterior opening 102.

FIG. 6 is an exploded view of the dispenser 101 depicted in the figures. FIG. 6 is also an inventory of parts, and a construction diagram for the dispenser 101 of FIGS. 4, 5, 7A, 7B and 7C. The components generally fit together by following the dashed line from the top left to the bottom right of the FIG. 6. More specifically, after substance has been loaded into the chamber 128, the piston 125 couples with plunger shaft 121

(AA to AA') and together the piston 125 and plunger shaft 121 merge approximately coaxially with the reservoir body 127 through its anterior, such that the piston 125 defines an anterior, inner wall of chamber 128 and plunger shaft 121 is extended out of the reservoir body 127 rear. The exposed end of the plunger shaft 121 suitably inserts coaxially into the resister 126 (BB to BB'), and coaxially into the driver 129 (CC to CC') by way of cooperating grooves 35 at the plunger shaft 21 and driver 29 interface. The resister 126 and driver are suitably positioned at the reservoir body anterior in the resistor path 145 and driver path 131 respectively. The driver 29 is positioned so that its posterior portion inserts coaxially into the female, anterior end of the crank 130 (DD to DD'), and so the driver teeth 133 are subject to interaction with crank teeth 134 (EE to EE'). Any portion of the plunger shaft 121 which remains exposed from the driver 129 will also suitably be inserted into the crank 130 with the driver 129 posterior. The crank 130 posterior is operationally configured for insert into plunger spring 123 without obstructing the crank path 132. In the present embodiment, a male member 146 having a reduced diameter relative to the main portion of the crank 130, protrudes from the crank 130 posterior which member 146 may then be inserted into anterior of the plunger spring 123 (FF to FF'). The difference in diameter between the member 146 and the main portion of the crank 130 prevents the plunger spring 123 from obstructing the crank path 132. The posterior of the plunger spring 123 is thereafter inserted into the crank housing 140 cavity (GG to GG') wherein crank guide 141 is positioned for unobstructedly traversing/reversing crank path 132 (HH to HH') as discussed above. Thereafter all the aforementioned components beginning with the reservoir body 127 and ending with the crank housing 140 are positioned within the plunger cavity 108 so that the grip 144 and channel 143 align with the appropriate cooperating locations within the plunger cavity 108, and so the reservoir body 127 interacts with the plunger 109 at plunger track 136 (II to II'). The arm 116 may then be attached to the anterior of the reservoir body 127 (JJ to JJ'). The applicator shaft 115 is usually coaxially inserted through the shoot press 124 so that the shoot press 124 is adjacent to the reservoir body 127 anterior (KK to KK'). The retraction spring 119 may then be placed around the applicator shaft 115 (LL to LL') but into the shoot press 124 (MM to MM'). The posterior of spring stop 120 inserts masculinely into spring 119 (NN to NN') but femininely receives the applicator shaft 115 (OO to OO') and usually abuts the shoot press 124. The applicator tip 118 may then be positioned at the distal end of applicator shaft 115 (PP to PP'). The applicator tip 118 may then be positioned/inserted at the anterior portion of cap housing 122 (QQ to QQ'). The cap shoots 110 are fastened to shoot press 124 (RR to RR') and passed through the spring stop 120 at notch 147 and the cap housing 122 (SS to SS'), after which they are fastened to cap 105 as shown in FIG. 6. The cap 105 may then be situated at the cap housing 122 (TT to TT'). Finally, all afore mentioned components, beginning with the plunger 109 and ending with the cap housing 122, are inserted into the anterior opening of the dispenser body 103 until the plunger 109 is prevented from further extending out from the anterior opening 104 (UU to UU') by the nub 138, and the cap housing 122 is forced into the body 103 anterior (VV to VV').

After contained substance stock is sufficiently diminished by dispenser 101 use, the dispenser 101 may be disposed of or replenished with substance. If replenishment of substance is desired, usually the internal components are reset accordingly and the chamber re-stocked with substance. This application contemplates that a dispenser 101, and reservoir, may be either disposable or refillable.

The figures depict the dispenser 101 with a rigid but hollow tubular body 103, a rigid but hollow cylindrical plunger 109, and other components of various shapes and relative sizes. However, the body 103 and plunger 103 need not be tubular or cylindrical but may be any shape seen fit by a person skilled in the applicable art. In addition to cylinders, other shapes, including, but not limited to squared, polygonal shapes, may be employed. Similarly, the various components shape and relative size may also be so modified. For example, a dispenser 101 depicted by the figures may have the general appearance of a right cylinder, but the general appearance may also be that of any three-dimensional object.

The materials suitable for forming the dispenser 101 and its components will vary depending on the physical properties of the substance contained, and the nature of the expected dispenser 101 use. The proper combination of materials for contained substance will be readily apparent to those skilled in the art. Keeping that in mind, the components of a dispenser 101 may be formed using a variety of preferable materials, including but not limited to metals, alloys, composites, woods, and a variety of hard plastics including but not limited to high-density polyethylene, polypropylenes, PVC, and other materials that will be appreciated by those skilled in the art.

I claim:

1. A hand-held cosmetic dispenser comprising:

a reservoir which is operationally configured to hold at least one substance;

a body which houses said reservoir;

an applicator which is electively extended from, or retracted within said body, wherein said applicator is operationally configured to permit discharge of said substance;

a means for electively extending said applicator from said body;

a means for electively locking said applicator in an extended position, wherein such means are operationally configured to electively be unlocked;

a means for electively retracting said applicator within said body when said applicator is extended therefrom; and, a means for electively and repetitively inducing movement of said substance held by said reservoir toward said applicator, wherein said means for inducing movement of said substance comprises a piston disposed in the reservoir, a plunger shaft, a drive gear, and a crank.

2. The hand-held dispenser of claim 1 wherein said applicator is defined by a tip and a channel, said channel operationally configured to allow movement of said substance toward said tip, said tip being defined by at least one surface operationally configured to permit passage of said substance through said surface.

3. The hand held-dispenser of claim 2 wherein said dispenser is operationally configured to preclude said electively induced movement of said substance while said tip is within said body.

4. The hand-held dispenser of claim 2, further comprising:

an electively sealable and unsealable opening on said body wherein said opening is operationally configured to permit extension or retraction of said applicator from said body when said opening is unsealed; and, a means for electively sealing or unsealing said opening.

5. The hand held-dispenser of claim 4 wherein said dispenser is operationally configured to preclude said electively induced movement of said substance while said applicator is within said body.

6. The hand held-dispenser of claim 4 wherein said induced movement is metered.

7. The hand held-dispenser of claim 4 wherein said substance is held in said reservoir is a cosmetic substance.

8. The hand-held dispenser of claim 1 further comprising:

an electively concealable and exposable opening on said body wherein said opening is operationally configured to permit extension or retraction of said applicator from said body when said opening is exposed; and, a means for electively exposing or concealing said opening.

9. The hand held-dispenser of claim 1 wherein said dispenser is operationally configured to preclude said electively induced movement of said substance while said applicator is within said body.

10. The hand held-dispenser of claim 1 wherein said induced movement is metered.

11. The hand-held dispenser of claim 1 further comprising:

an electively sealable and unsealable opening on said body wherein said opening is operationally configured to permit extension or retraction of said applicator from said body when said opening is unsealed; and, a means for electively sealing or unsealing said opening.

12. The hand held-dispenser of claim 11 wherein said dispenser is operationally configured to preclude said electively induced movement of said substance while said tip is within said body.

13. The hand held-dispenser of claim 12 wherein said induced movement is metered.

14. The hand held-dispenser of claim 11 wherein said induced movement is metered.

15. The hand held-dispenser of claim 11 wherein said substance held in said reservoir is a cosmetic substance.

16. The cosmetic dispenser of claim 11 wherein the a means for electively sealing or unsealing said opening further comprises:

a cap, operationally configured to seal said opening when substantially positioned thereover; and at least one cap shoot associated with said means for exposing said applicator tip.

17. The cosmetic dispenser of claim 16 wherein said cap shoot extends from within said opening simultaneous with said tip exposure thereby removing said cap from said opening, and wherein said cap shoot(s) retreats back within said opening thereby substantially re-positioning said cap over said opening.

18. The cosmetic dispenser of claim 17 wherein the a means for electively sealing or unsealing said opening further comprises at least one flexor flexibly connected at one end to said dispenser, and at another end to said cap, wherein said flexor guides said cap away from said tip substantially during said tip exposure, and wherein said flexor guides said cap toward said opening substantially during said tip concealment.

19. The cosmetic dispenser of claim 16 wherein the a means for electively sealing or unsealing said opening further comprises at least one flexor flexibly connected at one end to said dispenser, and at another end to said cap, wherein said flexor guides said cap away from said tip substantially during said tip exposure, and wherein said flexor guides said cap toward said opening substantially during said tip concealment.

20. The dispenser of claim 11 wherein said means for selectively sealing and unsealing said opening is a substantially air or water tight pocket.

21. A hand-held cosmetic dispenser comprising:

a reservoir which is operationally configured to hold at least one substance;

a body which houses said reservoir;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

a electively concealable and exposable opening on said body wherein said opening is operationally configured to permit extension or retraction of said applicator from said body when said opening is exposed;

a means for electively exposing or concealing said opening;

a means for electively extending said applicator from said body;

a means for electively locking said applicator in an extended position from said body and through said exposed opening, wherein said means are operationally configured to electively be locked or unlocked;

a means for electively retracting said applicator within said body when said applicator is extended therefrom; and, a means for electively and repetitively inducing metered movement of said substance held by said reservoir along said channel toward said tip, wherein said means for electively and repetitively inducing metered movement of said substance comprises a piston configured to move said substance(s) held by said reservoir, and wherein said dispenser is operationally configured to preclude said electively induced movement of said substance while said tip is within said body.

22. The hand held dispenser of claim 21 wherein said substance held by said reservoir is a cosmetic substance.

23. A hand-held cosmetic dispenser comprising:

a reservoir which is operationally configured to hold at least one substance;

a body which houses said reservoir, wherein said body is sealed;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

a electively sealable and unsealable opening on said body wherein said opening is operationally configured to permit extension or retraction of said applicator from said body when said opening is unsealed;

a means for electively sealing or unsealing said opening;

a means for electively extending said applicator from said body;

a means for electively locking said applicator in an extended position from said body and through said exposed opening, wherein such means are operationally configured to electively be unlocked;

a means for electively retracting said applicator within said body when said applicator is extended therefrom; and, a means for electively and repetitively inducing metered movement of said substance held by said reservoir along said channel toward said tip, wherein said means for electively and repetitively inducing metered movement of said substance comprises a piston configured to move said substance(s) had by said reservoir, and wherein said dispenser is operationally configured to preclude said electively induced movement of said substance while said tip is within said body.

24. The hand-held dispenser of claim 23 wherein said substance held by said reservoir is a cosmetic substance.

25. The dispenser of claim 23 wherein said means for selectively sealing and unsealing said opening is a substantially air or water tight pocket.

26. A hand-held dispenser comprising:

a reservoir which is operationally configured to hold at least one substance, wherein said dispenser and reservoir are operationally configured for substance refill;

a body which houses said reservoir;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

a electively concealable and exposable opening on said body wherein said opening is operationally configured to permit extension or retraction of said applicator from said body when said opening is exposed;

a means for electively exposing or concealing said opening;

a means for electively extending said applicator from said body;

a means for electively locking said applicator in an extended position from said body and through said exposed opening, wherein such means are operationally configured to electively be unlocked;

a means for electively retracting said applicator within said body when said applicator is extended therefrom; and, a means for electively and repetitively inducing metered movement of said substance held by said reservoir along said channel toward said tip, wherein said means for electively and repetitively inducing metered movement of said substance comprises a piston configured to move said substance(s) held by said reservoir, and wherein said dispenser is operationally configured to preclude said electively induced movement of said substance while said tip is within said body.

27. The hand held dispenser of claim 26 wherein said substance held by said reservoir is a cosmetic substance.

28. A hand-held dispenser comprising;

a reservoir which is operationally configured to hold at least one substance, wherein said dispenser and reservoir are operationally configured for substance refill;

a body which houses said reservoir, wherein said body is sealed;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

a electively sealable and unsealable opening on said body wherein said opening is operationally configured to permit extension or retraction of said applicator from said body when said opening is unsealed;

a means for electively sealing or unsealing said opening;

a means for electively extending said applicator from said body;

a means for electively locking said applicator in an extended position from said body and through said exposed opening, wherein such means are operationally configured to electively be unlocked;

a means for electively retracting said applicator within said body when said applicator is extended therefrom; and, a means for electively and repetitively inducing metered movement of said substance held by said reservoir along said channel toward said tip, wherein said means for electively and repetitively inducing metered movement of said substance comprises a piston and plunger shaft which are configured to move said substance(s) held by said reservoir, and wherein said dispenser is operationally configured to preclude said electively induced movement of said substance while said tip is within said body.

29. The hand-held dispenser of claim 28 wherein said substance held by said reservoir is a cosmetic substance.

30. The dispenser of claim 28 wherein said means for selectively sealing and unsealing said opening is a substantially air or water tight pocket.

31. A cosmetic dispenser comprising:

a reservoir which is operationally configured to hold at least one cosmetic substance;

a body which houses said reservoir;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

a electively concealable and exposable opening on said body wherein said opening is operationally configured to permit extension or retraction of said applicator from said body when said opening is exposed;

a means for electively exposing or concealing said opening;

a means for electively extending said applicator from said body;

a means for electively locking said applicator in an extended position from said body and through said exposed opening, wherein such means are operationally configured to electively be unlocked;

a means for electively retracting said applicator within said body when said applicator is extended therefrom; and, a means for electively and repetitively inducing metered movement of said substance held by said reservoir along said channel toward said tip via a piston that is mechanically connected to a depressible plunger, wherein said dispenser is operationally configured to preclude said electively induced movement of said substance while said tip is within said body.

32. A cosmetic dispenser comprising:

a reservoir which is operationally configured to hold at least one cosmetic substance;

a body which houses said reservoir, wherein said body is sealed;

an applicator which is electively extended from, or retracted within said body, wherein said applicator is defined by a tip and a channel, said channel operationally configured to allow movement of said substance toward said tip, said tip being defined by at least one surface operationally configured to permit passage of said substance through said surface;

an electively sealable and unsealable opening on said body wherein said opening is operationally configured to permit extension or retraction of said applicator from said body when said opening is unsealed;

a means for electively sealing or unsealing said opening;

a means for electively extending said applicator from said body;

a means for electively locking said applicator in an extended position from said body and through said exposed opening, wherein such means are operationally configured to electively be unlocked;

a means for electively retracting said applicator within said body when said applicator is extended therefrom; and, a piston-means for electively and repetitively inducing metered movement of said substance held by said reservoir along said channel toward said tip, wherein said dispenser is operationally configured to preclude said electively induced movement of said substance while said tip is within said body.

33. The dispenser of claim 32 wherein said means for selectively sealing and unsealing said opening is a substantially air or water tight pocket.

34. A cosmetic dispenser comprising:

a reservoir operationally configured for holding substances in a body of said cosmetic dispenser;

a retractable or extendable applicator;

a channel disposed between said applicator and said reservoir;

a means for electively exposing and concealing said applicator; and, a means for inducing movement of said substance inside said reservoir along said avenue toward said applicator while said applicator is exposed, wherein said means for inducing movement comprises a plunger shaft that is turned by a crank and driver to move a piston through the reservoir.

* * * * *